US007383605B2

(12) United States Patent
Anderson et al.

(10) Patent No.: US 7,383,605 B2
(45) Date of Patent: Jun. 10, 2008

(54) CARPET FRESHER RELEASE/DISPENSER/ATTACHMENT/ BRACKET

(75) Inventors: Steven Anderson, 8121 Birchfield Dr., Indpls., IN (US) 46268; Marilyn E. Anderson, Indpls., IN (US); Valerie McNair, Marion, IN (US)

(73) Assignee: Steven Anderson, Indpls., IN (US)

( * ) Notice: Subject to any disclaimer, the term of this patent is extended or adjusted under 35 U.S.C. 154(b) by 726 days.

(21) Appl. No.: 10/684,941

(22) Filed: Nov. 8, 2004

(65) Prior Publication Data

US 2006/0096056 A1 May 11, 2006

(51) Int. Cl.
*A47L 7/00* (2006.01)

(52) U.S. Cl. ..... 15/320; 15/327.1; 15/246.2

(58) Field of Classification Search ..... 15/320, 15/318, 319, 338, 246.2, 246.1, 327.1
See application file for complete search history.

(56) References Cited

U.S. PATENT DOCUMENTS 3,108,312 A 10/1963 Ballantyne
4,183,112 A * 1/1980 Brown et al. ..... 15/50.1
4,240,569 A * 12/1980 Bessinger ..... 222/220
4,268,935 A * 5/1981 Bessinger ..... 15/320
4,381,157 A 4/1983 Brown
4,457,042 A 7/1984 Jones et al.
5,086,539 A 2/1992 Rench
5,101,532 A 4/1992 Dyson et al.
7,152,273 B2 * 12/2006 Courtney ..... 15/320
2006/0096056 A1 * 5/2006 Anderson et al. ..... 15/320

* cited by examiner

*Primary Examiner*—Lee D Wilson

(57) ABSTRACT

A dispenser removably attached to a vacuum cleaner for easy access to distribute carpet and room deodorizer. The dispenser may have a Velcro attachment to mount on the vacuum cleaner to enable the dispenser to fit all upright models or standard cleaners. The carpet and room deodorizer is poured into the dispenser and can be releaser by the push of a button or switch.

2 Claims, No Drawings

CARPET FRESHER RELEASE/DISPENSER/ATTACHMENT/ BRACKET

CROSS-REFERENCE TO RELATED APPLICATION

<None>

FIELD OF THE INVENTION

The present invention relates generally to a dispenser/bracket that is removably attached from a vacuum cleaner for easy access while releasing a carpet room deodorizer.

BACKGROUND OF INVENTION

Individuals use carpet freshener in their homes by manually dispensing the freshener. It would be better to have an attachment dispenser making it easier to dispense the carpet cleaner. The individual could have an attachment connected to the vacuum for this very purpose.

SUMMARY OF INVENTION

The invention is understood to relate generally to manufacturers interested in a powder dispenser attachment on a vacuum cleaner. More specifically, the invention itself is a vacuum cleaner attachment that includes a powder or liquid dispenser, which releases a carpet freshener onto a carpet surface. This attachment/bracket will allow the user to be hands free of a carpet freshener because it will be attached alongside the upright. Perhaps even more so, it will also reduce the number of steps used when vacuuming and will have the room fragranced with one less step. But even more basic, this dispenser/bracket will not only alleviate the use of any hands on rituals but serve as a great utility as it champions its way through the shutter doors of glory, as it releases the carpet room deodorizer onto the carpet floor.

DETAILED DESCRIPTION OF THE DRAWINGS FIGURES

<None>

DETAILED DESCRIPTION

The carpet freshener is released by pushing a button or pulling a chain that is mounted along side the vacuum cleaner while a user operates the vacuum cleaner. The invention is understood to relate generally to manufacturers interested in a powder dispenser attachment on a vacuum cleaner. The pushing of a button or pulling of a chain can also be replaced with an open and closed shutter door. The shutter door will have a lever that controls the canister part of the attachment. This lever will operate the switch that will release the carpet freshener amount. The levels will regulate the flow and the amount of carpet freshener being released as the vacuum is being pushed. It will have three levels: low, medium or high flows. The switch will thus control the amount and time of dispensing while the vacuum is in operation.

The invention claimed is:

1. A method of freshening a carpet, comprising the steps of:

providing a carpet freshener in a powder dispenser removably attached to a vacuum cleaner;

and releasing carpet freshener from said powder dispenser while operating said vacuum cleaner, said powder dispenser comprising a canister, a shutter door, a lever that has three regulating levels controlling an amount of powder and a timer switch which controls an amount of time of the dispensing while the vacuum cleaner is operated.

2. An attachment for use with a vacuum cleaner comprising:

a powder dispenser having a canister, a shutter door, a lever that has three regulating levels controlling an amount of a powder and a timer switch which controls an amount of dispensing time of said powder and wherein said powder dispenser is further comprising a mechanism for removable attachment.

* * * * *